United States Patent [19]

Abu-Shumays et al.

[11] Patent Number: 4,593,907

[45] Date of Patent: Jun. 10, 1986

[54] POLYHEDRAL AND SPERICAL CUBIC PUZZLES

[76] Inventors: Ibrahim K. Abu-Shumays; Mary D. Abu-Shumays, both of 1248 Varner Rd., Pittsburgh, Pa. 15227

[21] Appl. No.: 394,869

[22] Filed: Jul. 2, 1982

[51] Int. Cl.[4] ..... A63F 9/08

[52] U.S. Cl. ..... 273/153 S

[58] Field of Search ..... 273/153 S, 155

[56] References Cited

U.S. PATENT DOCUMENTS

| | | | |
|---|---|---|---|
| 3,655,201 | 4/1972 | Nichols | 273/153 S X |
| 4,344,623 | 8/1982 | Isobe | 273/153 S |
| 4,378,117 | 3/1983 | Rubik | 273/153 S |

FOREIGN PATENT DOCUMENTS

| | | | |
|---|---|---|---|
| 8108498 | 9/1981 | Fed. Rep. of Germany | 273/153 S |
| 170062 | 12/1977 | Hungary | 273/153 S |

*Primary Examiner*—Anton O. Oechsle

*Attorney, Agent, or Firm*—William J. Ruano

[57] ABSTRACT

This invention introduces several new Polyhedral Puzzles based on variations and extensions to the 2×2×2 cube. Spherical and shell analogue puzzles are also disclosed. These puzzles are of "Rubik's" Cube and "Pyraminx" tetrahedron class (Rubik's Cube is a registered trademark of Ideal Toy Corporation, "Pyraminx" is a registered trademark of Tomy Corporation). Main features and examples of the puzzles are briefly described. Each of the puzzles is comprised of component pieces which are joined and held together by an appropriate mechanism to form a desired overall shape. Each surface of a puzzle is to be assigned a unique color or picture. The mechanism of motion makes it possible to rotate the individual component pieces of a puzzle in groups in planes and around axes emanating from the center of the puzzle. Various possible rotations (twists and turns) result in mixing up the surface configurations. The object and the challenge is to restore the various surfaces of a puzzle into their original form, or to perform twists and turns that would result in alternate interesting designs. The mechanisms of rotation include new operational mechanisms as well as improvements and extensions to existing mechanisms. The invention yields a variety of challenges.

20 Claims, 53 Drawing Figures

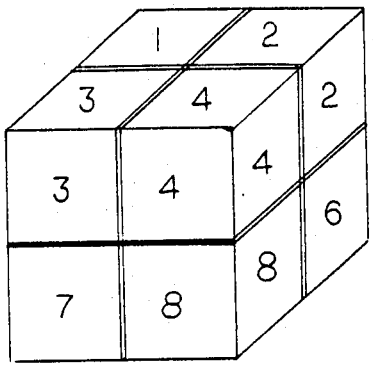
FIG. 1a.
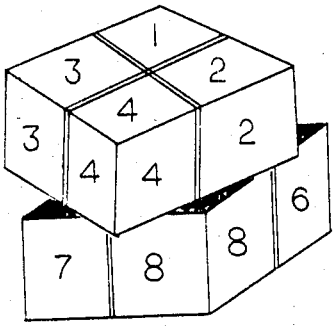
FIG. 1b.
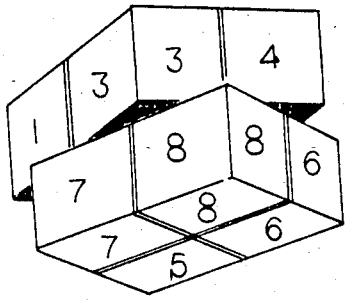
FIG. 1c.
FIGURE 1.

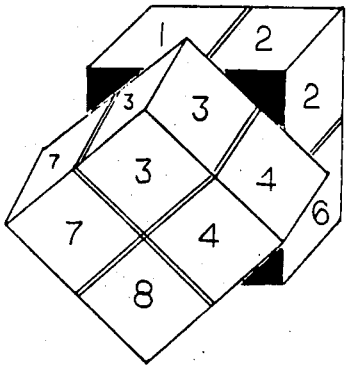
FIG. 1d.
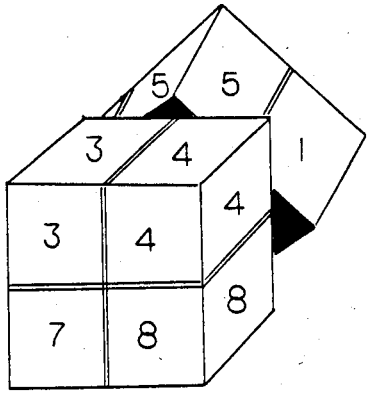
FIG. 1e.
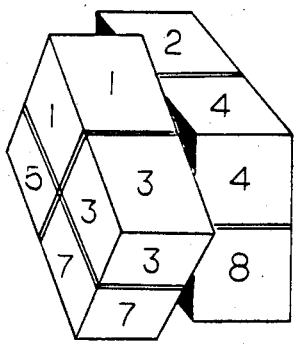
FIG. 1f.
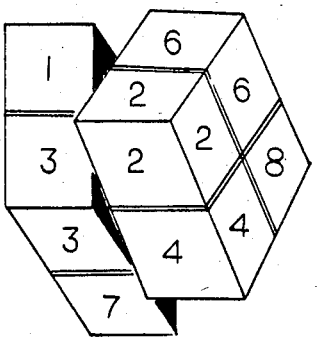
FIG. 1g.
FIGURE 1 (Cont.)

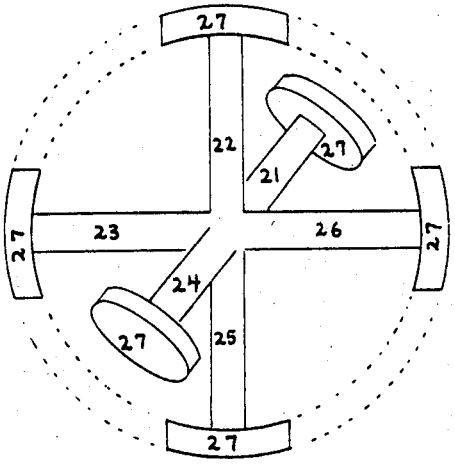
FIG. 2a.
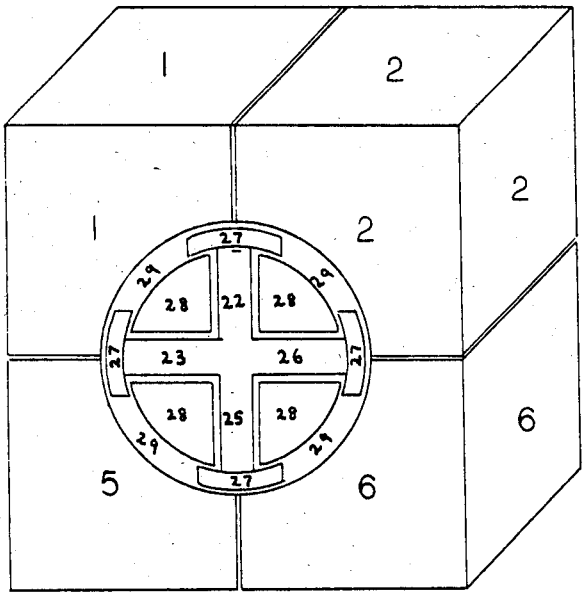
FIG. 2b.
FIGURE 2.

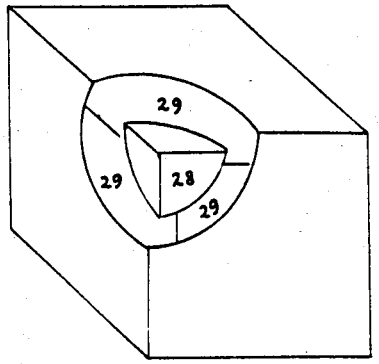
FIG. 2c.
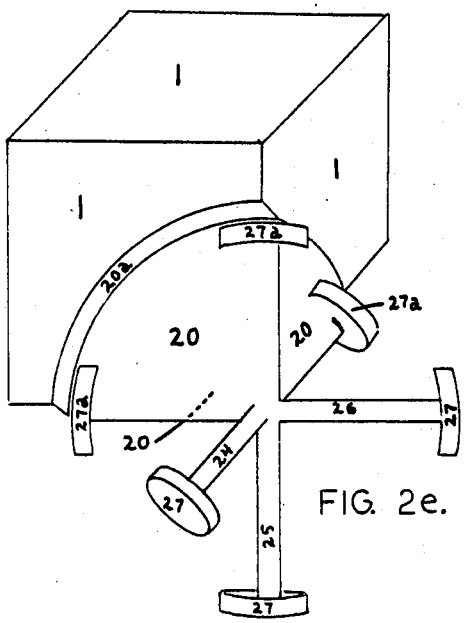
FIG. 2e.
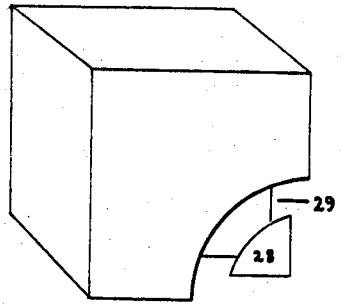
FIG. 2d.
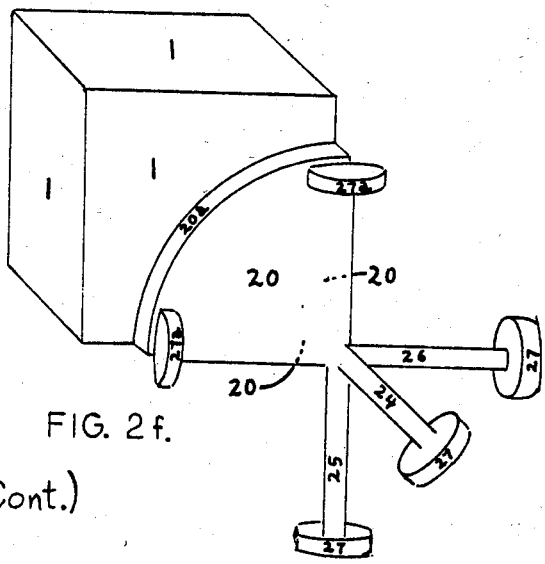
FIG. 2f.
FIGURE 2(Cont.)

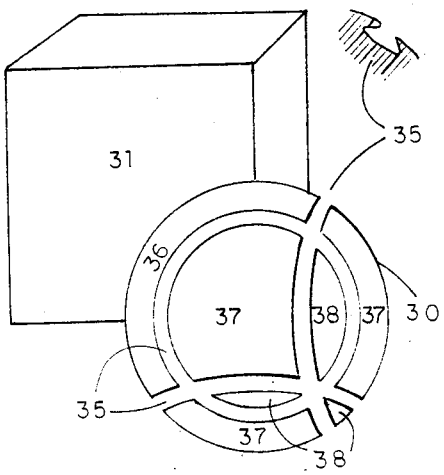
FIG. 3a.
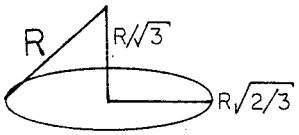
FIG. 3b.
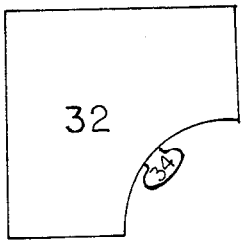
FIG. 3c.
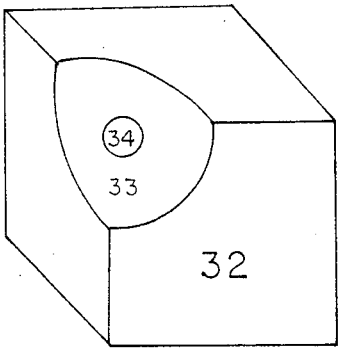
FIG. 3d.
FIGURE 3.

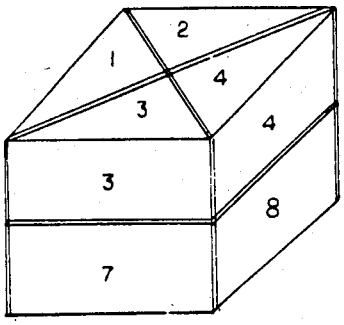
FIG. 4a.
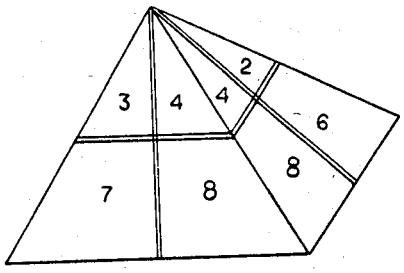
FIG. 4b.
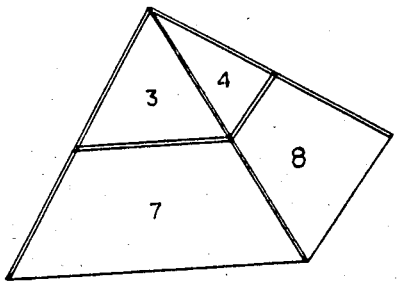
FIG. 4c.
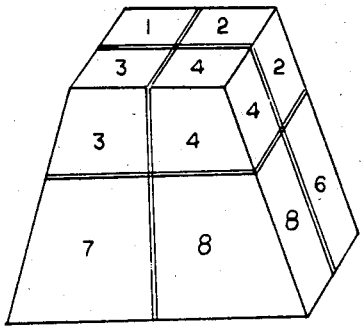
FIG. 4d.
FIGURE 4.

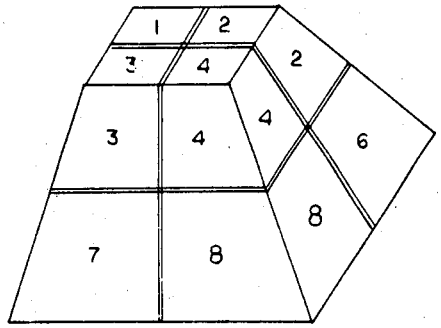
FIG. 4e.
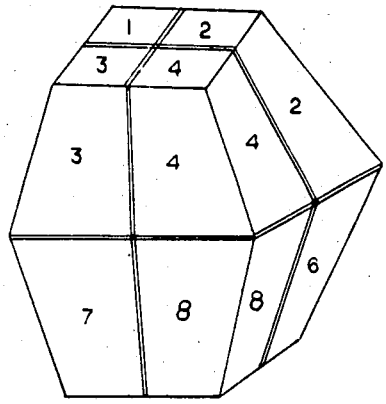
FIG. 4f.
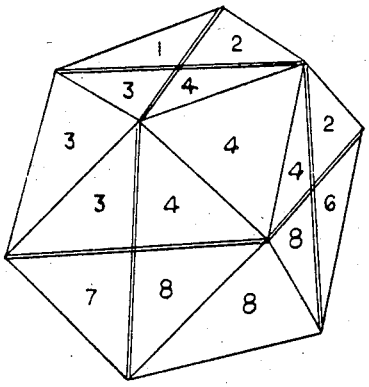
FIG. 4g.
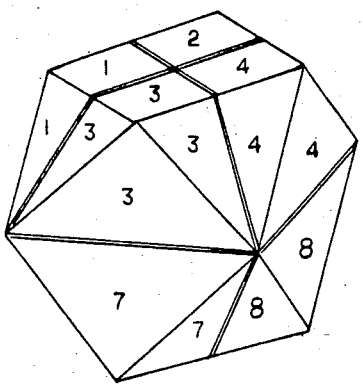
FIG. 4h.
FIGURE 4. (CONT.)

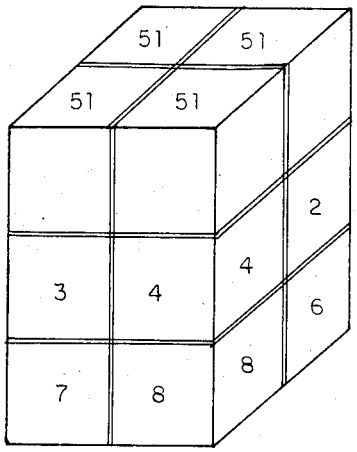
FIG. 5c.
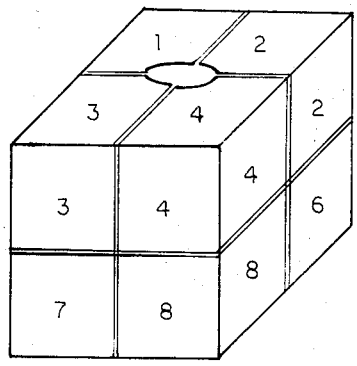
FIG. 5b.
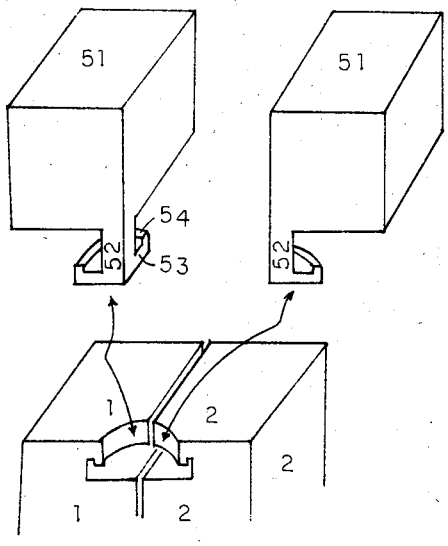
FIG. 5c.
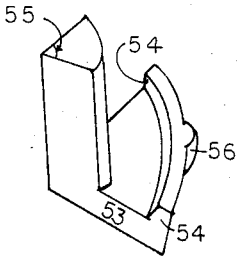
FIG. 5d.
FIGURE 5.

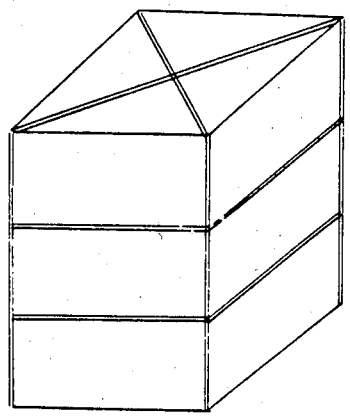
FIG. 6a.
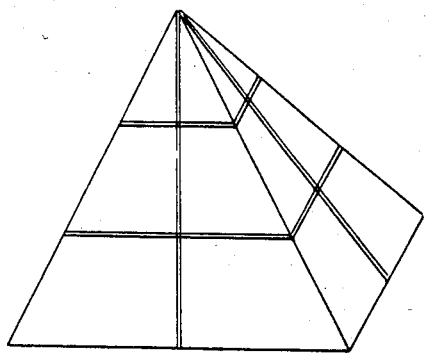
FIG. 6b.
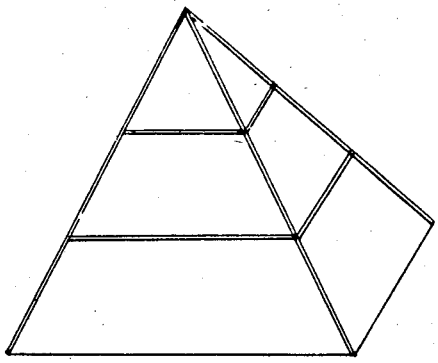
FIG. 6c.
FIGURE 6.

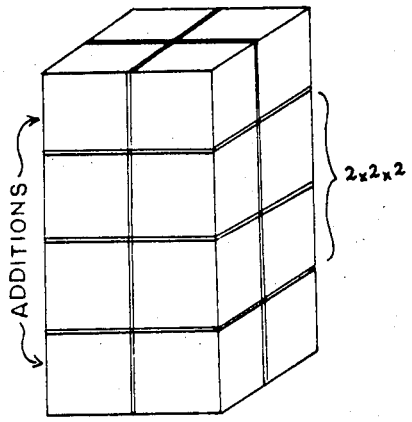
FIG. 7a.
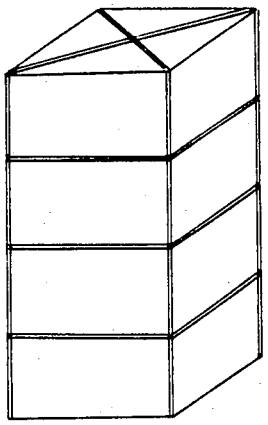
FIG.7b.
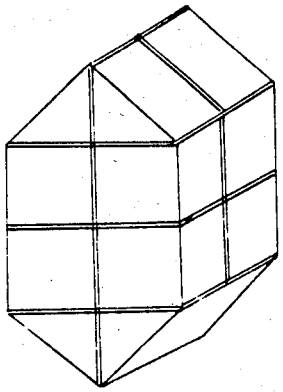
FIG. 7c.
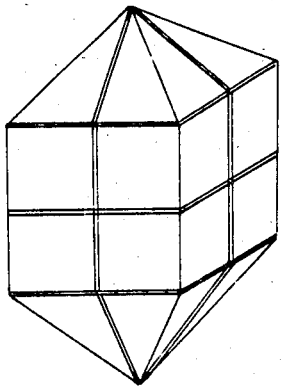
FIG. 7d.
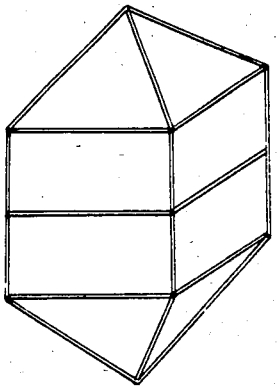
FIG. 7e.
FIGURE 7.

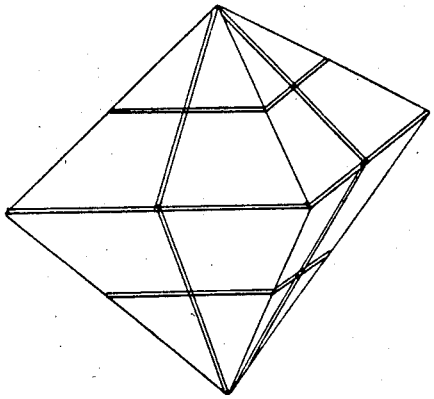
FIG. 7f.
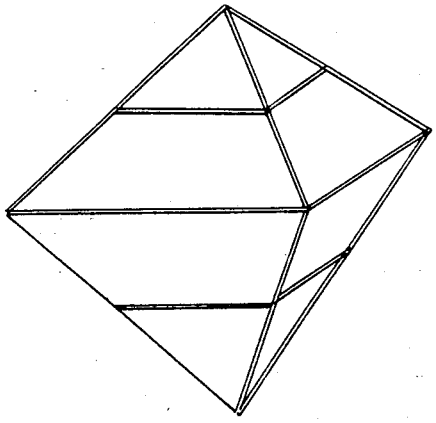
FIG. 7g.
FIGURE 7. (CONT.)

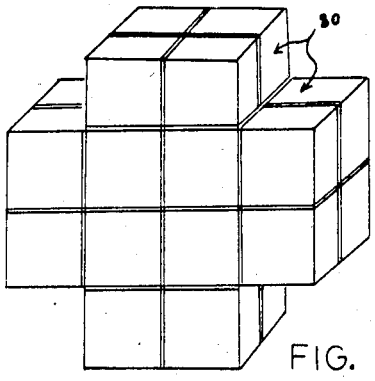
FIG. 8a.
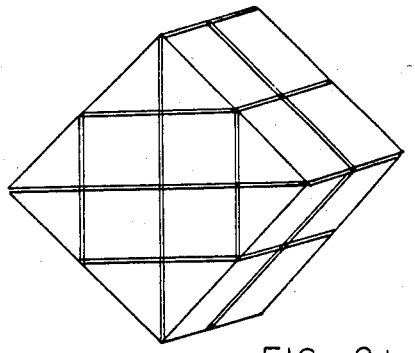
FIG. 8b.
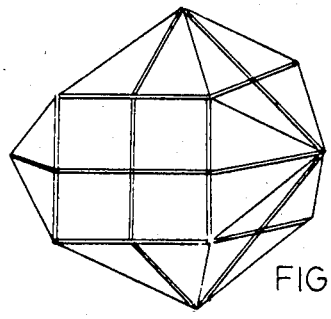
FIG. 8c.
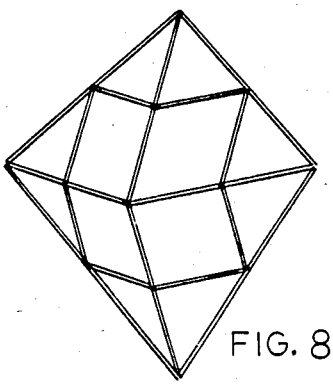
FIG. 8d.
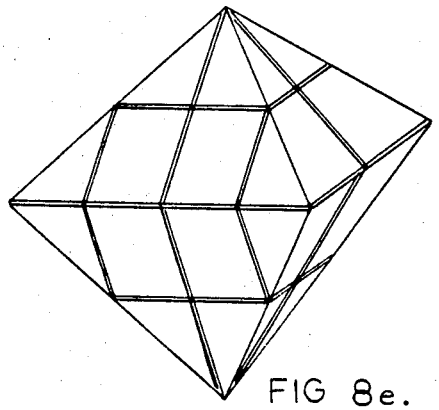
FIG 8e.
FIGURE 8.

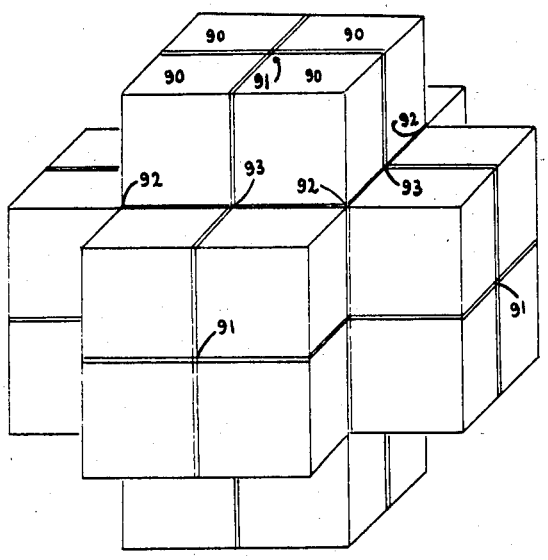
FIG. 9a.
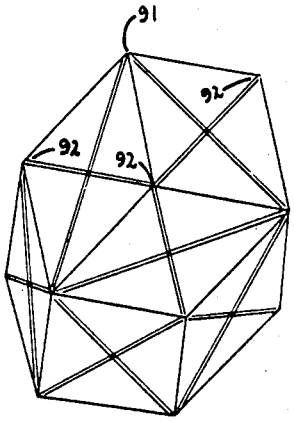
FIG. 9c.
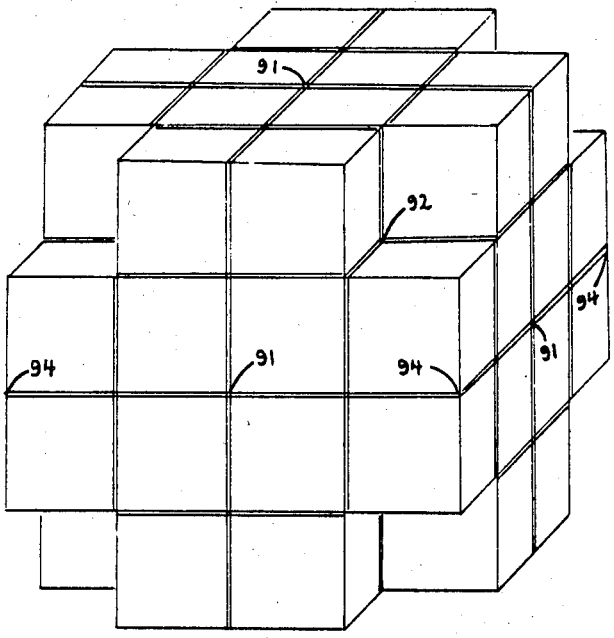
FIG. 9b.
FIGURE 9.

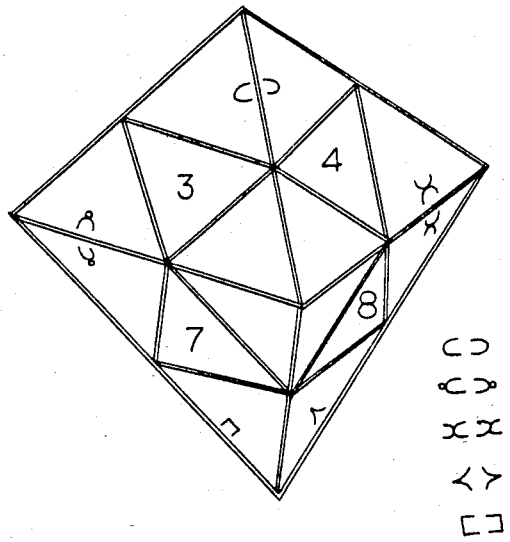
FIG. 9d
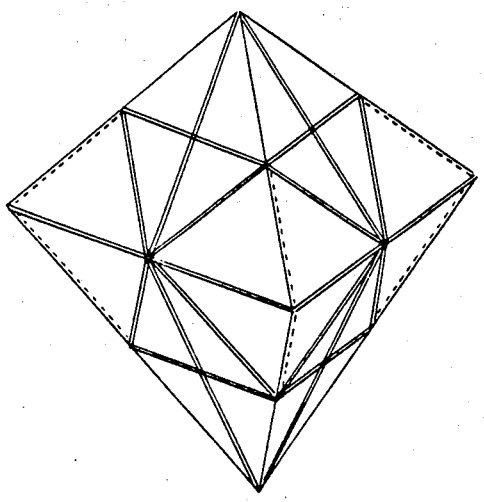
FIG. 9e.
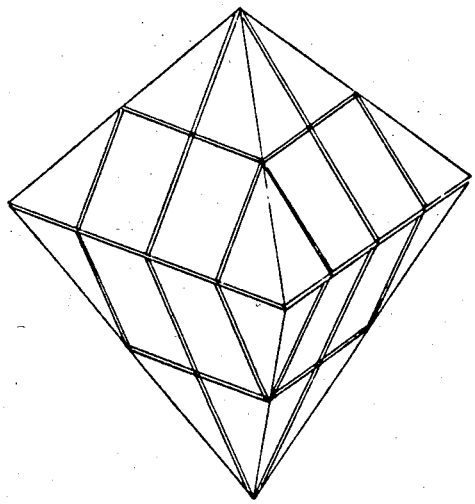
FIG. 9f.
FIGURE 9. (CONT.)

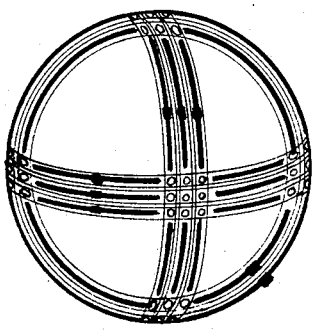
FIGURE 10a.
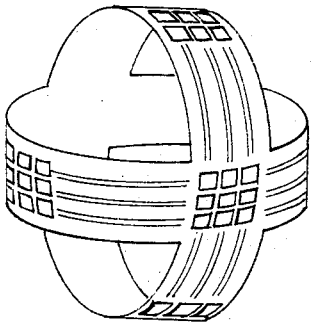
FIGURE 10b.
| | | |
|---|---|---|
| 4 | 9 | 2 |
| 3 | 5 | 7 |
| 8 | 1 | 6 |
| | | |
|---|---|---|
| 4 | 3 | 8 |
| 9 | 5 | 1 |
| 2 | 7 | 6 |
| | | |
|---|---|---|
| 8 | 18 | 4 |
| 6 | 10 | 14 |
| 16 | 2 | 12 |
FIGURE 11.

POLYHEDRAL AND SPERICAL CUBIC PUZZLES

BACKGROUND OF THE INVENTION

1. Field of the Invention

This invention relates to cubic class polyhedral puzzles based on variations and extensions of the 2×2×2 cube. Spherical and shell analogue puzzles are also disclosed. Each puzzle is comprised of various pieces which rotate in groups relative to each other in such a way as to alter the surface configurations. Each surface configuration is assigned a particular color, picture, number or design. The objecet and the challenge is to perform twists and turns aimed at restoring the surfaces to their original configuration or to other interesting designs.

2. Description of the Prior Art

This invention generalizes the "Rubik's" Cube (Rubik's Cube is a registered trademark of Ideal Toy Corporation), "Pyraminx" tetrahedron ("Pyraminx" is a registered trademark of Tomy Corporation), and similar cubic puzzles. This invention introduces a variety of shapes, a wide range of challenges, and ease of assembly.

SUMMARY OF THE INVENTION

This invention introduces the following class of polyhedral puzzles: (a) the 2×2×2 cube, (b) symmetric and non-symmetric polyhedral analogues or variants to the 2×2×2 cube and (c) more challenging and interesting polyhedral puzzles which either extend the 2×2×2 cube or extend the polyhedron variants to the 2×2×2 cube.

Variants to the 2×2×2 cube can be viewed as being formed by altering the external shape of sub-cubes of said cube. Sample variants to the 2×2×2 cube introduced have external structures in the form of pyramids, truncated pyramids, barrels, truncated cubes, etc. The subject truncated cubes have six square faces and eight equilateral triangular faces.

Extensions to the 2×2×2 cube and to its variants are formed by adjoining additional sub-structures to said cube and said variants to form new cubic puzzles. One or more of the faces of said 2×2×2 cube or the faces of its variants can be extended by adding sub-structures to result in puzzles with non-symmetric, partially symmetric and fully symmetric structures. The additional sub-structures illustrated include sub-cubes, pyramids, and prisms. The most interesting new puzzles are the fully symmetric puzzles introduced, and these have the overall shapes of (a) a large truncated cube formed by adjoining four sub-cubes over each face of the 2×2×2 cube, (b) a diamond-faced dodecahedron formed by adjoining four similar pyramids of appropriate size and shape to each face of the 2×2×2 cube and (c) octahedrons formed by adjoining pyramids of appropriate size and shape to each of the square faces of the truncated cube variants of the 2×2×2 cube.

Also disclosed are ellipsoidal shapes corresponding to cubic puzzles, a sample spherical balls in groove and a sample of sliding plates analogue puzzles. Finally the use of magic squares is recommended for faces of a 3×3×3 cube and its analogue spherical balls in groove and sliding plates puzzles.

All the puzzles introduced here are of the cubic class whereby the surface configurations can be altered by twists and turns and the challenge is to restore the surfaces to the original configuration or to other interesting designs. The overall shapes, number of visible external pieces, degree and variety of challenge or internal operational mechanisms are improvements and extensions to those for existing puzzles.

No mention is made here of the material to construct these puzzles. It may be plastic, wood, metal or a combination. Spring support and ball bearings to enhance the quality of motion of some of the puzzles is desirable as is now standard. Since these items are not new, they are not discussed further.

Exact dimensions are not mentioned, since this is a relative matter. Also dimensions along different directions can be varied, as for example along the vertical direction in FIG. 4*d* discussed below. Relative dimensions are provided when essential.

BRIEF DESCRIPTION OF THE DRAWINGS

Other objects and advantages of the invention will become more apparent from a study of the following description taken with the accompanying drawings wherein:

FIG. 1 is a sample of perspective views showing the following: FIG. 1*a* is the 2×2×2 cube referred to here as Adam's cube. The double lines in this figure and in the remaining figures signify separation of adjoining sub-pieces and indicate borders of planes of rotation. FIGS. 1*b–g* show possible rotations of the cube's component pieces along three orthogonal planes.

FIG. 2 is a sample of perspective views of two possible operational working mechanisms for the 2×2×2 cube together with the internal structure of the component sub-cubes.

The first operational mechanism in FIG. 2 is shown in FIGS. 2*a–d*. Specifically FIG. 2*a* shows an orthogonal axial system with six shell knobs; FIG. 2*b* shows a mid cross-sectional view; and FIGS. 2*c,d* show perspective views of one of the eight identical sub-cubes with the unexposed internal corner being recessed and being surrounded by a groove. For this first operational mechanism to function properly, one and only one of the eight sub-cubes of FIGS. 2*c,d* must be fixed in position between three knobs of the frame in FIG. 2*a* and must not be allowed to move relative to the frame.

The second and "preferred" operational mechanism in FIG. 2 is shown in FIGS. 2*c–f*. Here seven of the eight sub-cubes are free sub-cubes and retain the sahpe in FIGS. 2*c,d* with their unexposed corners modified as above. The remaining sub-cube, say sub-cube number 1, is integrated and made part of the frame by extending its unexposed corner in a symmetric fashion and adjoining to this corner three orthogonal axis rods of rotation. Each of the three identical rods of rotation is combined at its extremity with a knob which fits in the grooves in the assembled position. The extended corner of sub-cube 1 terminates by portions of a spherical surface. The three extended edges of the unexposed corner are combined each with a knob which serves the same function and has the same distance from the center of the puzzle as the knobs at the end of said axis rods of rotation.

FIG. 3 is a sample of perspective views showing an alternalte operational mechanism for the 2×2×2 cube with (i) FIG. 3*a* showing one sub-cube integrated into a center sphere and with three orthogonal circular grooves carved from the surface of the sphere, (ii) FIG. 3*b* showing fixed position of mid plane of a groove relative to the center of sphere and (iii) FIGS. 3*c,d* showing perspective views of one sub-cube of seven identical free sub-cubes with the internal corner of said sub-cube modified and with a knob adjoined to it. The knob fits in the grooves and is aimed at holding the sub-cube in position and allowing rotations around the center sphere. The cross-section of each groove may be modified to enhance motion.

FIG. 4 is a collection of perspective views showing eight sample polyhedral variants to the 2×2×2 cube formed by altering the shape of the external surfaces of the 2×2×2 cube and its eight sub-cubes to form the following polyhedral shape puzzles: FIG. 4*a* is a diagonal cube, FIG. 4*b* is a pyramid, FIG. 4*c* is a diagonal pyramid, FIG. 4*d* is a trapezoidal shape, FIG. 4*e* is a truncated pyramid, FIG. 4*f* is a barrel, FIG. 4*g* is a truncated cube, and FIG. 4*h* is a truncated diagonal cube.

FIG. 5 is a sample of perspective views showing how to extend one surface of the 2×2×2 cube to get a 12 sub-cube stick. Perspective views show (a) FIG. 5*a*, the 12 sub-cube stick, and (b) FIGS. 5*b–d*, the modifications to the 2×2×2 cube and the extended parts of the additional sub-cubes which would hold them in place and allow admissible rotations.

FIG. 6 is a collection of perspective views showing sample variants to the 12 sub-cube stick of FIG. 5, formed by modifying the external surfaces to from the following polyhedral shapes: FIG. 6*a* is a 12 piece diagonal stick, Fig. 6*b* is a pyramid, and FIG. 6*c* is a diagonal pyramid.

FIG. 7 is a collection of perspective views showing a square-based right prism (cartesian stick) in FIG. 7*a* formed by extending two opposite faces of the 2×2×2 cube and also showing sample variants to this extension of the 2×2×2 cube formed by modifying the external surfaces to form the following polyhedral shapes: FIG. 7*b* is a diagonal square-based right prism shape, FIGS. 7*c–e* are parcel shapes and FIGS. 7*f,g* are bi-pyramid octahedral shapes.

FIG. 8 is a collection of perspective views showing in FIG. 8*a* a plus or cross formed by extending a pair of opposite faces of the 2×2×2 cube, and also showing sample variants to this extension of the 2×2×2 cube formed by modifying the external surfaces to form the following polyhedral shapes: FIG. 8*b* is diamond, FIG. 8*c* is a truncated diamond and FIGS. 8*d,e* are bi-pyramid octahedrons.

FIG. 9 is a sample of perspective views showing in FIGS. 9*a,b* two additional symmetric extensions to the 2×2×2 cube and showing the following sample polyhedral variants to these extensions to the 2×2×2 cube: FIG. 9*c* is a diamond-faced dodecahedron, and FIGS. 9*d–f* are octahedral shapes. The double lines denote subdivisions between the various external pieces. The dashed lines in FIG. 9*e* denote locations of additional desirable subdivisions of external pieces of this puzzle. The puzzle of FIG. 9*c* can be regarded as being formed either by a direct extension of the puzzles of FIGS. 1*a* and 8*c* or by replacing each set of four sub-cubes over a face of the 2×2×2 cube central part of the puzzle of FIG. 9*a* by a four-piece pyramid, said pyramid having a face of the 2×2×2 cube as its square base and having a height equal in length to one of the sides of the 2×2×2 cube. The puzzles of FIGS. 9*d–f* can be regarded as being formed by modifying or cutting out parts of the pieces of the puzzles in FIGS. 9*a,b*. The puzzles in FIGS. 9*d,e* can also be regarded as direct extensions of the puzzles in FIGS. 4*g,h* respectively.

FIG. 10 is a perspective view of (a) a sample of spherical balls in grooves and (b) a sample of sliding plates analogue puzzles.

FIG. 11 is a sample of magic squares recommended for faces of the Rubik's cube and its analogue puzzles shown in FIGS. 10*a,b*. In a magic square the sum of each row, column, or diagonal is a constant.

DESCRIPTION OF THE PREFERRED EMBODIMENTS

This invention introduces a class of cubic puzzles including (a) the 2×2×2 cube, (b) Polyhedral analogues (variants) to this cube having symmetric and non-symmetric shapes, and (c) symmetric and non-symmetric polyhedral puzzles which extend the basic puzzles of the 2×2×2 cube and variants to this cube; said extensions are achieved by adjoining additional structures to these basic puzzles. Polyhedral extensions to the 2×2×2 cube and its variants considered here are accomplished by (i) direct extension of the 2×2×2 cube by increasing the number of sub-cubes by multiples of four, and (ii) by modifying the shapes of the resulting puzzles, which in some cases is equivalent to extending the polyhedral variants to the 2×2×2 cube. The simple puzzle of FIGS. 5*a–d* discussed below demonstrates a new mechanism for accomplishing the extensions of the 2×2×2 cube and its polyhedral variants.

All the puzzles discussed here are generalizations and improvements to the concepts embodied in Rubik's Cube (Rubik's Cube is a registered trademark of Ideal Toy Corporation) and in "Pyraminx" tetrahedron (Pyraminx is a registered trademark of Tomy Corporation).

Other objects and advantages of the invention will become more apparent from a study of the description of the drawings given above and from the additional description given in the next several numbered paragraphs. For convenience, a double line notation is adopted in the drawings to indicate separation of adjoining sub-pieces and also to indicate borders of planes of rotation of sub-pieces.

1. The 2×2×2 Cube

The 2×2×2 cube is the simplest puzzle described and is also viewed here as a building block for several other puzzles. It will be described in more detail than other puzzles in order to clarify the terminology and to simplify reference and indications of potential rotations (turns and twists).

The 2×2×2 cube is composed of 8 external component sub-cube pieces, 7 of which are visible in the perspective view FIG. 1*a*. The overall cube has 6 external surfaces and each of these surfaces is assumed to have a unique color, picture, numbering system or design.

The double lines in the figures for the 2×2×2 cube and for the other puzzles are used throughout to indicate separation of adjoining sub-pieces and also to indicate borders of planes of rotation of the sub-pieces. To explain this terminology note the following: (i) The double lines in FIG. 1*a* separating the top and bottom pieces signify possible horizontal rotations as is shown in FIG. 1*b* and FIG. 1*c*. (ii) The double lines separating the front and back pieces signify possible vertical rotations in the plane of the paper as is shown in FIG. 1*d* and FIG. 1*e*. (iii) The double lines separating the left and right pieces signify possible vertical rotations orthogonal to the plane of the paper as is shown in FIG. 1*f* and FIG. 1*g*. For brevity, perspective views of rotations for all other puzzles covered by this invention are omitted.

Alternative possible functional operating mechanisms for holding the external pieces of the 2×2×2 cube together and for allowing the rotations shown in FIGS. 1*b–g* will now be described. The reason for selecting alternative mechanisms is to allow flexibility in manufacturing and to allow for generalizations of the concepts involved.

(A) OPERATIONAL MECHANISM 1. To describe this mechanism consider first the frame of three orthogonal axis rods shown in FIG. 2*a* with a knob segment of a spherical shell attached to the ends of each rod. The rods are assumed to be of the same length. The individual knobs may or may not rotate around their respective axis, and may be attached by a spring mechanism to facilitate assembly and possible disassembly. Such a frame of rod system is capable of holding together all sub-cubes of the 2×2×2 cube. Each combination of three knobs of the frame holds one sub-cube in place. A central cross-sectional view of such a configuration is shown in FIG. 2*b*. FIG. 2*c* and FIG. 2*d* show perspective views of the inner side of a typical sub-cube: (a) a recessed central part which normally sits between knobs of the frame to make it possible to hold the sub-cubes to the central frame, and (b) grooves around the central part which allow rotations around the central frame knobs. The mechanism described here is adequate as an operational mechanism, provided one of the sub-cubes and only one is fixed in position between three knobs of the frame and is not allowed to move relative to the frame.

(B) OPERATIONAL MECHANISM 2—THE PREFERRED MECHANISM. An improved mechanism, based in part on Mechanism 1 but with one sub-cube forming an integral part of the internal frame can be manufactured with sub-cube 1 of FIG. 1 being part of the frame as is shown in FIGS. 2*e,f*. In summary, for the preferred mechanism, (i) Sub-cube 1 is an integral part of the frame and has the form shown in FIGS. 2*e,f*. The circular knobs in FIG. 2*f* (and also in FIGS. 2*a,b*) may or may not rotate and the three of them which are joined by rods can be attached via tight springs to allow ease of assembly. (ii) Each of the remaining seven sub-cubes has the form shown in FIGS. 2*c,d*. The knobs make it possible to hold the sub-cubes together and to allow the various rotations described above.

(C) OPERATIONAL MECHANISM 3. The main idea here is to make sub-cube 1, the principal sub-cube, an integral part fixed to a spherical center and covering an octant of the sphere. See FIG. 3*a*. Three circular grooves are made on the spherical center, with the plane passing through each groove parallel to a face of the principal sub-cube. The main radius r of each circular groove is related to the radius R of the sphere by $r=\frac{2}{3}R$. A perspective view of the grooves is shown in FIG. 3*a*. Cross-sections of grooves may be modified to enhance motion.

Each of the seven remaining free sub-cubes has an octant of a sphere cut out of it and replaced with a guide knob which fits in the groove and holds the sub-cube to the sphere. FIGS. 3*c,d* show one of seven typical free sub-cubes. The grooves and the knobs should be such as to allow ease of rotation.

2. Variants to the 2×2×2 Cube

The essential features of a 2×2×2 cube are the number of external pieces, the functional operating mechanism and the possible rotations. If the center core of the cube is relatively small as compared to the rest of the cube then the sub-cubes of the puzzle can be "reshaped" in other interesting designs. FIGS. 4*a–h* show eight sample variations. Note that symmetric (external pieces have identical shapes, see FIGS. 4*f,g,h*) and non-symmetric shapes are allowed. Also dimensions along different directions can be varied, as for example, along the vertical direction in FIG. 4*d*. These and other variations may be of interest in themselves and can also be applied as basic parts of more sophisticated puzzles. Note that the double lines suffice to indicate edges of planes of rotation and to convey admissible turns and twists. For example, the double lines in FIG. 4*a* imply that (a) the top and bottom pieces can rotate relative to each other, and (b) the various pieces can also rotate parallel to diagonal planes. FIGS. 4*a–h* also show numbers for each external piece and these numbers correspond to the sub-cubes of FIG. 1*a*. FIG. 4*g*, which is the most interesting of these variants, is essentially identical to the 2×2×2 cube, but with a tetrahedron cut out of every corner sub-cube. FIGS. 4*d–f* can be made to correspond to the diagonal cube variant of FIG. 4*a*, rather than to the 2×2×2 cube of FIG. 1*a*. As an illustration, the alternative subdivision of FIG. 4*g* is shown as FIG. 4*h*.

3. Twelve-piece extendable Stick and its Variants

To demonstrate possible mechanisms for extending a puzzle we illustrate first the 12-piece stick of FIG. 5*a*. This is made up by adding four sub-cubes to one face, say the top face of the 2×2×2 cube. This extension can be accomplished in two ways: (a) by a circular groove at the top of the 2×2×2 cube and by knobs at the bottoms of the additional 4 sub-cubes to hold these new sub-cubes in position above the 2×2×2 cube, and to allow for the rotations implied in FIG. 5*a*; (b) by the arrangement demonstrated in FIGS. 5*b–d*, and favored in this invention. Here a cylindrical hole with a widening lower part is carved from say the top sub-cubes 1, 2, 3 and 4 of the 2×2×2 cube as is shown in FIGS. 5*b,c*. FIG. 5 *c* shows a perspective view of the modifications to the top parts of sub-cubes 1 and 2 and the implication is that the same modification is done to the adjacent sub-cubes 3 and 4 as is implied in FIG. 5*b*. FIG. 5*c* also exhibits the extensions to the sub-cubes that would fit above the sub-cubes 1 and 2 of the 2×2×2 cube. FIG. 5*d* exhibits an expanded view of the knob extension to each sub-cube 51; said extension includes a lip 54 intended to stabilize the position; said lip may have an additional part 56 which may be replaced by a ball bearing. The details in FIG. 5*d* may be omitted or modified when not essential for the overall integrity of the puzzle.

A sample of three polyhedral variants to the subject puzzle of FIG. 5*a* is shown in FIGS. 6*a,b,c*. FIGS. 6*b* and 6*c* show pyramids with square bases, one a modification to FIG. 5*a* and the other to FIG, 6*a*. Another variant not shown is accomplished by modifying the heights of the individual pieces in FIG 5*a* to yield for example a cube as the overall shape.

4. Other Extensions to the 2×2×2 cube and their Variants

The above described how to adjoin a set of four sub-cubes to any side of the 2×2×2 cube. The top side of the 2×2×2 cube was singled out only for illustration. Since the 2×2×2 cube has six square faces, it is clear that any number of these faces can be extended in the manner described above, resulting in new puzzles and new variants to these puzzles. In fact, two or more sets of sub-cubes can be adjoined to a face if the extensions are modified appropriately.

(A) FIG. 7*a* shows two sets of sub-cubes adjoined to two opposite faces of the 2×2×2 cube forming a puzzle with 16 sub-cubes (13 sub-cubes are visible in the perspective view of FIG. 7*a;* the other sub-cubes are hidden). FIGS. 7*b–g* shows a sample of 6 variants to this puzzle: a diagonal stick in FIG. 7*b,* parcel shapes in FIGS. 7*c–e* and octahedral shapes in FIGS. 7*f,g.* Note in particular that FIGS. 7*f,g* represent bi-pyramids sharing a common square base. FIG. 7*f* can be viewed as a straightforward extension to FIG. 4*f* by adding four tetrahedra to the top and four tetrahedra to the bottom of the configuration of FIG. 4*f.*

For the sake of brevity it suffices now to discuss additional symmetric arrangements of sub-cubes and some sample modifications thereof.

(B) FIG. 8*a* shows a plus formed by extending four faces of the 2×2×2 cube. One variation of the plus can be achieved by cutting half of each sub-cube extension to the 2×2×2 cube to yield the shape shown in FIG. 8*b.* Another extension shown in FIG. 8*c* can be formed by cutting the edge pieces in FIG. 8*b* to change the prism shape of every set of adjacent four edges into a pyramid with a square base. Note that the rectangular faces in FIG. 8*b* are transformed into parallelograms (diamonds) in FIG. 8*c.* FIGS. 8*d,e* show examples of additional modifications to the shapes of the pieces in FIGS. 8*a,b,c.* It should be noted that the octahedra in FIG. 8*d,e* have restricted symmetry and this may result in restricted rotations.

(C) The most interesting extension to the 2×2×2 cube is shown in FIG. 9*a* with four sub-cubes adjoined to each face of the 2×2×2 cube (see FIG. 5 and its discussion above). This puzzle has 6 square faces plus 24 rectangular faces. As the double lines in FIG. 9*a* imply, the various pieces of the puzzle can rotate in horizontal planes, in vertical planes parallel to the plane of the paper of this figure, and in vertical planes perpendicular to the plane of the paper. In other words, rotations can be achieved around three orthogonal axes of the puzzle. To make this puzzle challenging, it is recommended to use six distinct colors or identifications for the six square faces and only 12 additional colors or identifications for the remaining rectangular faces, with one distinct color or identification for each pair of adjacent rectangular faces. Such a choice of colors or designs renders the initial position unique.

Note that the 2×2×2 cube part of the puzzle in FIG. 9*a* is hidden and is invisible from the outside. Thus parts of the 2×2×2 cube central part of this puzzle can be cut off to result in a (modified) spherical shape, or triaxial shape. With this accomplished, additional sub-cubes can be added to the puzzle much in the same manner as is done for the Pyraminx Tetrahedron or Rubik's cube to form the puzzle shown in FIG. 9*b,* or a new cube with 16 squares on each face. The latter two puzzles would be extremely challenging and would not be for the average person.

(D) A new variation to the puzzle of FIG. 9*a* can be achieved by replacing each set of four sub-cubes over a face of the 2×2×2 cube by a four-piece pyramid with a face of the 2×2×2 cube as its square base and with height equal to one of the sides of a sub-cube of the 2×2×2 cube. The resulting configuration is one of the most interesting shapes. It is a DODECAHEDRON with 12 identical faces, each face a diamond (Parallelogram) with one diagonal $\sqrt{2}$ times the other. A perspective view showing six of the twelve faces of this puzzle is shown in FIG. 9*c.* This puzzle of FIG. 9*c* can also be view as a straightforward extension to the puzzle of FIG. 8*c,* achieved by adding square-based pyramids to each of the remaining square faces of the latter puzzle. The double lines in FIG. 9*c* again indicate possible rotations but may be misleading in part. To clarify the picture it is noted here that the subject Dodecahedron has two types of vertices, vertices common to 3 diamond faces and vertices common to four diamond faces. Admissible rotations are rotations around orthogonal axes which emanate from the center of gravity of the puzzle and pass through the vertices which are common to four faces. The rotations are the same as for the puzzle of FIG. 9*a* described above.

(E) Additional interesting puzzles can be formed by modifying or cutting out parts of the pieces of the puzzles in FIGS. 9*a,b.* Three such new puzzles have the overall shape of octahedrons (8-plane faces) and can also be viewed as extensions or modifications to the puzzles shown in FIGS. 4*g, h* and 8*e.*

The first of these puzzles shown in FIG. 9*d* can be obtained by adjoining to each of the 6 square bases of FIG. 4*g,* a four-piece pyramid (much the same as at the top of FIG. 4*c*). The adjoined pyramid has a square face of the puzzle in FIG. 4*g* as its base and has a height equal to half the length of one of the diagonals along its base. While the external shape of the external pieces of this puzzle is not new to the present inventors, the alternative working mechanisms are the sole invention of the present inventors. A perspective view of this octahedral puzzle is shown in FIG. 9*d.* Again the double lines indicate subdivisions of pieces of this puzzle and borders of planes of rotation. This puzzle becomes more interesting if the corresponding faces of the top and bottom halves are assigned identical colors or identifications or if the idea of links as indicated in FIG. 9*d* is adopted.

The second of these puzzles is shown in FIG. 9*e.* The steps that can be applied to extend the puzzle of FIG. 4*h* to yield the puzzles of FIG. 9*e* can be outlined as follows: (i) Adjoin a four-piece pyramid such as at the top of FIG. 4*b,* to each of the top and bottom square faces (each of these square faces has 4 sub-squares) in much the same manner as described in connection with FIG. 5. The base of the pyramid is the same as the square face to which it would be adjoined and the height of the pyramid is one-half the length of a diagonal along its base. Note that each of the four pieces of the pyramid has an extended part of the same shape as in FIG. 5*d* designed to fit in a hole and hold the piece in place. (ii) Form cylindrical holes and identations at the centers of the remaining four square faces (see the square face formed from the pieces numbered 3 and 7 or 4 and 8 in FIG. 4*h*). The resulting indentation or groove in piece 3 of FIG. 4*h* is equivalent to the hole that would result if the sub-cubes 1 and 2 of FIG. 5*c* were glued together. (iii) Form four four-piece square pyramids each of which has the same shape and extension as is implied for the pyramid at the top of FIG. 4*c* above. Adjoin one of each of these four-piece square pyramids to each of the remaining square faces described in (ii) above. This puzzle may be simplified by gluing or fusing pairs of pieces of the resulting four-piece pyramids and their extensions together to form two-piece square based pyramids and their extensions. In other words, the bottom of the extension in FIG. 5*d* was chosen to have a right angle for convenience, and the angle can be increased or decreased as needed. In the present case, the extension for the two-piece square pyramids is the same as when two-pieces of the form in FIG. 5d are glued together, but with one ball bearing centrally located in place of two ball bearings.

The above results in the bi-pyramid octahedron of FIG. 9e. The dashed line indicates the possibility of either two-piece or four-piece corner pyramids.

The third of these puzzles shown in FIG. 9f is another variation of a bi-pyramid corresponding to a modification to FIGS, 9b and 8e. Details are omitted for brevity.

5. Additional Disclosures

One objective here is to establish that most cubic puzzles can be transformed into spherical shapes. Spherical puzzles may have a special design to identify the correct location or locations of the various pieces or may have a picture of the globe.

Another objective is to disclose that the 2×2×2 cube, Rubik's cube and several other cubic puzzles can also be transformed into sliding plate type, or moving balls, that are restrained to move in grooves of a sphere or on a set of ring shells. One variation to such a puzzle is illustrated in FIG. 10a. The components of this puzzle are: (i) Sphere with a total of 9 or 6 circular grooves, 3 grooves running horizontally and 6 or 3 vertically. (ii) Six sets of balls. Each set has 9 balls with a unique identification (for a total of 54 balls.) In the reference position each set of 9 balls occupies neighboring intersections of the grooves. (iii) For this particular puzzle (for other puzzles, additional balls may be used here), a plastic, rubber or metal combination guide that fits in the groove and allows free motion or locked positions is provided. (iv) Part of the spherical shell could be attached with a screw to enable disassembly and rearrangement of the various balls.

Another variant of this puzzle is shown in FIG. 10b in the form of sliding plates on ring shells. One additional ring shell can be added to this puzzle.

The puzzles introduced here are more interesting and challenging than the 3×3×3 cube, though the reference positions are analogous to each other. In the 3×3×3 cube, all the 6 center pieces (centers of the square surfaces) are restricted to rotate in place and not to change their relative positions. In the subject puzzle, all the pieces can change their positions relative to each other.

A new variation to this puzzle and to the 3×3×3 cube and its present modifications is to label the balls or squares in the cube with numbers which can be combined to form so-called magic squares. A sample of magic squares, by no means exclusive, is shown in FIG. 11. Clearly any magic square can be transformed into another magic square by rotation, reflection, addition of a constant number to all numbers of the square, or multiplication of all numbers of the square by constant numbers. If magic squares are used, then the squares and the balls may be, but need not be, of multi-colors.

While we have illustrated and described several embodiments of our invention, it will be understood that these are by way of illustration only and that various changes, extensions and modifications may be contemplated in my invention and within the scope of the following claims.

We claim:

1. A sub-structure in the form of a sub-puzzle comprising eight external sub-structures stacked in the form of a large structure, wherein the first of said sub-structures having an extended internal cubic section; said extended cubic section having one corner extending a small distance beyond the center of the sub-puzzle and having three surfaces of equal distances from the center of the sub-puzzle; each of said three surfaces terminates by a narrow spherical strip of small width having a fixed radius R from the center of the puzzle; the end of each edge of the extended internal cubic section away from the center of the sub-puzzle is extended further by adjoining to it an edge guiding member which is a portion of a spherical shell; said spherical shell having an outer surface at a distance R from the center of the sub-puzzle; the corner of each of the three plane faces of said extended cubic section is further extended by a rod pivot oriented orthogonal to the surface and having a shell-like guiding member at its extremity; said guiding member having a small thickness and having an outer surface at a distance R from the center of the sub-puzzle; each of the remaining seven of said eight external sub-structures having a recessed cubic portion, said recessed cubic portion having one corner and three orthogonal surfaces, each surface extending up to a spherical groove, the center of the spherical surfaces of said groove being the center of the sub-puzzle, the width of the groove is slightly more than the width of the spherical shell heads of the rod pivots and the edge guiding members, and the outside surface of the groove is at a distance R from the center of the sub-puzzle; in the assembled form the six guiding members, three at the extremities of the three rod pivots and three at the outer edges of the extended cubic section of the first sub-structure, lie in the grooves of the remaining seven sub-structures thereby preventing disassembly of the sub-puzzle and making possible selective rotations in selective directions.

2. A sub-puzzle as recited in claim 1 wherein said large structure is in the form of a 2×2×2 cube and wherein each of its eight sub-structures is essentially a sub-cube with the unexposed corner section of said sub-cube modified.

3. A puzzle in the form of a 2×2×4 square based right prism, said puzzle formed by modifying and extending the 2×2×2 cube sub-puzzle of claim 2;

said modification consists of forming two shallow cylindrical grooves at two opposite faces of the 2×2×2 cube sub-puzzle, each groove starting at the center of an external face of the 2×2×2 cube sub-puzzle and extending around the common edges of a set of four adjacent sub-cubes, each of said grooves having a cross-section substantially in the form of a forward or backward letter J; an additional spherical indentation is formed at each central location of the portion of the backward curved groove section inside a sub-cube in order to stabilize the rest positions;

said extension consists of adjoining a set of four new right prisms over each of the two grooves, each of said new right prisms having a square base having the same dimensions as a face of the sub-cube of the 2×2×2 cube sub-puzzle, each of the four new right prisms is extended along the common edge of the four new right prisms by a knob in such a way that in the rest position, the four identical knobs of each four new right prisms adjoined to one face of the 2×2×2 cube sub-puzzle, fit in and practically fill the space of a groove;

admissible rotations, twists and turns make it possible for the new right prisms to rotate together over a face of the 2×2×2 sub-puzzle or to migrate from one face of the sub-puzzle to any other face.

4. A puzzle in the form of a cross with length of extensions arbitrary, said puzzle formed by additional modification and extension of the 2×2×4 puzzle recited in claim 3;

said additional modification and extension are accomplished by selecting two additional opposite faces of the central 2×2×2 cube sub-puzzle of said 2×2×4 puzzle, and by adjoining to each of said additional faces a set of four new square based right prisms; said additional modification and extension being the same as recited in claim 3 for modifying and extending two opposite faces of the 2×2×2 cube sub-puzzle in order to achieve the 2×2×4 puzzle.

5. A puzzle in the form of a diamond with two square faces and four rectangular faces formed by modifying and extending the 2×2×2 cube sub-puzzle of claim 2;

said modification consists of forming four shallow cylindrical grooves at two pairs of opposite faces of the 2×2×2 cube sub-puzzle, each groove starting at the center of an external face of the 2×2×2 cube sub-puzzle and extending around the common edges of a set of four adjacent sub-cubes, each of said grooves having a cross-section substantially in the form of a forward or backward letter J; an additional spherical identation is formed at each central location of the portion of the backward curved groove section inside a sub-cube in order to stabilize the rest position;

said extension consists of adjoining a set of four new right prisms over each of the four grooves; each of said sets of right prisms is viewed as being formed from a set of four external sub-cubes adjoined to and covering a face of the 2×2×2 cube sub-puzzle and with half of each external sub-cube cut off along a diagonal plane, said diagonal plane passing through an external edge of the 2×2×2 cube sub-puzzle, in the reference rest position said edge being in common between two adjacent extended faces of said central 2×2×2 cube sub-puzzle;

each set of four new right prisms is extended along the common edges of the four new right prisms by knobs in such a way that in the rest position, the four identical knobs of each four new right prisms adjoined to one face of the 2×2×2 cube sub-puzzle, fit in and practically fill the space of a groove;

admissible rotations, twists and turns make it possible for the new right prisms to rotate together over a face of the 2×2×2 cube sub-puzzle or to migrate from one face of the sub-puzzle to any other face.

6. A puzzle in the form of a dodecahedron with twelve identical size faces, each of said faces is a diamond parallelogram with one diagonal $\sqrt{2}$ times the other diagonal; said puzzle formed by modifying and extending the 2×2×2 cube sub-puzzle of claim 2;

said modification consists of forming a shallow cylindrical groove starting at the center of each external face of the 2×2×2 cube sub-puzzle and extending around the common edges of a set of four adjacent sub-cubes, said groove having a cross-section substantially in the form of a forward or backward letter J; an additional spherical indentation is formed at each central location of the portion of the backward curved groove section inside a sub-cube in order to stabilize the rest positions;

said extension consists of adjoining six sets of four-piece square based pyramids, one four-piece square based pyramid over each face of the 2×2×2 cube sub-puzzle; the base of each of said four-piece square based pyramids coincides with and has the same dimensions as a square face of the 2×2×2 cube sub-puzzle, the vertex of said pyramid lies directly above the center of the base, the height of said pyramid is equal to one of the sides of a sub-cube of the 2×2×2 cube sub-puzzle, and the sub-divisions of said pyramid are along planes which pass through the vertex and the mid-points of opposite sides of the base; each of the pieces of said four-piece square based pyramid is extended along the common edge of the four pieces by a knob in such a way that in the rest position, the four identical knobs of each four piece square based pyramid adjoined to one face of the 2×2×2 cube sub-puzzle, fit in and practically fill the space of a groove;

admissible rotations, twists and turns make it possible for the pieces of a four piece square based pyramid to rotate together over a face of the 2×2×2 cube sub-puzzle or to migrate from one face of the sub-puzzle to any other face.

7. A puzzle in the form of a truncated 4×4×4 cube with all the corner and edge pieces removed, said puzzle formed by modifying and extending the 2×2×2 cube sub-puzzle of claim 2;

said modification consists of forming six shallow cylindrical grooves, each groove starting at the center of an external face of the 2×2×2 cube sub-puzzle and extending around the common edges of a set of four adjacent sub-cubes, each of said grooves also having a wider lower part followed by a backward curved groove section, and each of said grooves having a cross-section substantially in the form of a forward or backward letter J; an additional spherical indentation is formed at each central location of the portion of the backward curved groove section inside a sub-cube in order to stabilize the rest positions;

said extension consists of adjoining a set of four new sub-cubes over each of the six grooves, each of said new sub-cubes having the same dimensions as a sub-cube of the 2×2×2 cube sub-puzzle, each of the four new sub-cubes is extended along one edge by a knob in such a way that in the rest position, the four identical knobs of each four new sub-cubes adjoined to one face of the 2×2×2 cube sub-puzzle fit in and practically fill the space of a groove;

admissible rotations, twists and turns make it possible for the 24 new sub-cubes to rotate in groups over a face of the sub-puzzle or to migrate from one face of the sub-puzzle to any other face.

8. A puzzle as recited in claim 7 together with 24 new sub-cubes adjoined to it by means of grooves and knobs to form a 4×4×4 large cube with the eight corner sub-cubes of said large cube missing;

said groove being formed by cutting out portions of a spherical shell around each edge of the 2×2×2 cube sub-puzzle of the original puzzle of claim 7; said spherical shell having a center coinciding with the center of the original puzzle, having an inner radius slightly less than the distance between the center of the puzzle and the mid-point of an edge of the 2×2×2 cube sub-puzzle and having an outer radius slightly more than said distance;

said knobs are identical sections of the cut out portions of said spherical shell, each knob being adjoined to an edge of one of said 24 new sub-cubes in such a way that in the rest position the knob fits in a portion of the groove and holds its corresponding new sub-cube in place to prevent disassembly;

admissible rotations, twists and turns make it possible for the knobs to migrate in the groove and make it possible for the external sub-cubes of the puzzle to migrate from place to place.

9. A puzzle formed by modifying and extending the 2×2×2 cube sub-puzzle of claim 2;

said modification consists of forming two shallow cylindrical grooves at two opposite faces of the 2×2×2 cube sub-puzzle, each groove starting at the center of an external face of the 2×2×2 cube sub-puzzle and extending around the common edges of a set of four adjacent sub-cubes, each of said grooves having a cross-section substantially in the form of a forward or backward letter J; an additional spherical indentation is formed at each central location of the portion of the backward curved groove section inside a sub-cube in order to stabilize the rest positions;

said extension consists of adjoining two four-piece square based pyramids to the two grooves, the square base of each of said pyramids coincides with and has the same dimensions as a square face of the 2×2×2 cube sub-puzzle; the vertex of each of said pyramids lies directly above the center of its base; each of said pyramids is cut into four parts along planes which pass through its tip vertex and the mid-points of opposite sides of its base; each sub-piece of a pyramid is extended along the common edge of the sub-pieces by a knob in such a way that in the rest position, the four identical knobs of each four-piece square based pyramid fit in and practically fill the space of a groove.

10. A puzzle as recited in claim 1 wherein said large structure is in the form or a truncated cube having six square faces and eight triangular faces; said truncated cube being formed from a large cube by cutting off eight corner tetrahedra, each tetrahedron being defined by a corner vertex and by mid-points of the three edges of said large cube which emanates from said corner vertex.

11. A sub-puzzle as recited in claim 1 wherein said large structure is in the form of a 2×2×2 ellipsoid and wherein each of its eight sub-structures is an octant of an ellipsoid with the unexposed corner section of each of said sub-structures modified; said ellipsoid including a sphere as a special case.

12. A puzzle as recited in claim 1 together with N sets of sub-structures adjoined to N of its surfaces to form a new large structure, where N is a number between one and six inclusive (N=1, . . . , 6), and wherein each of said sets of sub-structures is comprised of a number of sub-structures.

13. A puzzle as recited in claim 12 wherein said new large structure is in the form of an ellipsoid; said ellipsoid including a sphere as a special case.

14. A puzzle as recited in claim 12 wherein N is one (N=1) and wherein said new large structure is a right prism comprised of three quartets of right prisms stacked above each other.

15. A puzzle as recited in claim 12 comprising 24 (N=4) sub-structures wherein said new large structure is in the form of a truncated diamond with two square faces, four parallelogram faces (with one diagonal $\sqrt{2}$ times the other diagonal) and eight triangular faces.

16. A puzzle as recited in claim 12 comprising 24 (N=6) external sub-structures wherein said large structure is in the form of a dodecahedron with twelve identical size faces, each of said faces is a diamond parallelogram with one diagonal $\sqrt{2}$ times the other diagonal;

the central part of said puzzle being a 2×2×2 cube sub-structure; the external part is comprised of six sets of four-piece square based pyramids being adjoined to the six faces of the 2×2×2 cube central part;

admissible rotations, twists and turns make it possible for the external pieces to rotate over faces of the 2×2×2 cube central part or to migrate from face to face of said cube central part.

17. A puzzle in the form of an octahedron with eight faces; said octahedron puzzle being formed by modifying and extending the six square faces of the 2×2×2 truncated cube puzzle of claim 6;

said modification consists of forming six shallow cylindrical grooves, each groove starting at the center of an external square face of the 2×2×2 truncated cube puzzle and extending around an axis orthogonal to said square face, each of said grooves also having a wider lower part followed by a backward curved groove section, and each of said grooves having a cross-section substantially in the form of a forward or a backward letter J; an additional spherical indentation is formed at each central location of the portion of the backward curved groove section inside a truncated sub-cube in order to stabilize the rest positions;

said extensions consist of adjoining six sets of four-piece square based pyramids, one pyramid over each of the six grooves; the square base of said pyramid coincides with and has the same dimensions as a square face of the 2×2×2 truncated cube puzzle; the vertex of said pyramid lies directly above the center of the base, the height of said pyramid is equal in length to one half the length of a diagonal of its base;

each of said square based pyramids is cut into four parts along planes which pass through its top vertex and the diagonals of its base;

the sub-pieces of said four-piece square based pyramid are extended along their common edges by identical knobs in such a way that in the rest position, the four identical knobs of each four-piece square based pyramid adjoined to one face of the 2×2×2 truncated cube fit in and practically fill the space of a groove;

admissible rotations, twists and turns make it possible for the sub-pieces of the new four-piece square based pyramids to rotate above or migrate from one square face of the 2×2×2 truncated cube puzzle to another square face.

18. A puzzle based on the sub-puzzle of claim 2 wherein the eight external sub-structures of the sub-puzzle of claim 2 are substantially in the form of sub-cubes forming a 2×2×2 sub-structure; said 2×2×2 sub-structure being modified and extended to form an octahedron with eight plane faces;

said modification consists of forming six shallow cylindrical grooves, each groove starting at the center of an external face of the 2×2×2 sub-structure and extending around an axis orthogonal to said external face, each of said grooves also having a varying and wider lower part; and modification also consists of parts of cylindrical grooves starting around the edges of the 2×2×2 sub-structure and having wider inner parts;

said extension is comprised of the following: (a) adjoining two four-piece square based pyramids to the top and bottom faces of the 2×2×2 sub-structure; each of these four-piece pyramids having a top vertex directly above the center of its square base, having a height equal in length to one half the length of its base and is cut into four parts along planes which pass through its top vertex and the mid-points of opposite sides of its base; each sub-piece of said four-piece square based pyramid is extended along the common edge of the sub-pieces by a knob in such a way that in the rest position the four identical knobs of each four-piece square based pyramid fit in and practically fill the space of a groove; (b) adjoining four four-piece right triangular prisms to the four vertical faces of the 2×2×2 sub-structure, each of these four-piece right prisms is viewed as being formed from a set of four external sub-cubes adjoined to and covering a vertical face of the 2×2×2 sub-structure and with half of each external sub-cube cut off along a diagonal plane, said diagonal plane passing through an external horizontal edge of the 2×2×2 sub-structure; the sub-pieces of said four-piece right triangular prism are extended along their common edges by identical knobs in such a way that in the rest position, the four identical knobs fill the space of a groove; a further groove is formed on the outside vertical edges of the four-piece right triangular prism to form extensions to the grooves at the edges of the 2×2×2 sub-structure; and (c) adjoining two identical pyramids to each of the eight vertical edges of the 2×2×2 substructure by means of knobs which fit in part of grooves in such a manner as to hold the pyramids in place, prevent disassembly and allow the admissible rotations; the pyramids are of such a shape and size as to complete the octahedral shape of the subject puzzle.

19. A sub-puzzle as recited in claim 1 wherein said large structure is in the form of a truncated 2×2×2 cube having six square faces and eight triangular faces;

said puzzle being achieved by first selecting said large structure in the form of a cube with the subdivisions leading to the eight sub-structures and with the admissible rotations being (i) along two planes of each of said two planes passing through two opposite edges labelled vertical edges of said cube, and (ii) along a third plane, say a horizontal plane which is orthogonal to the first two planes and which passes through the center of said cube;

said puzzle being achieved by secondly cutting off eight corner tetrahedra, each tetrahedron being defined by four vertices, said four vertices being (i) one of the eight corner vertices of said cube and (ii) the mid-points of the three edges of the cube which emanate from that corner vertex.

20. A puzzle in the form of an octahedron; said octahedron puzzle being formed by modifying and extending the six square faces of the truncated 2×2×2 cube sub-puzzle of claim 19;

said modification consists of forming six shallow cylindrical grooves, each groove starting at the center of an external square face of the truncated 2×2×2 cube sub-puzzle and extending around an axis orthogonal to said square face, each of said grooves also having a wider lower part followed by a backward curved groove section, and each of said grooves having a cross-section substantially in the form of a forward or a backward letter J; an additional spherical indentation is formed at each central location of the portion of the backward curved groove section inside a sub-cube in order to stabilize the rest positions;

said extension consists of adjoining six sets of four-piece square based pyramids, one pyramid over each of the six grooves; the square base of said pyramid coincides with and has the same dimensions as a square face of the truncated 2×2×2 cube sub-puzzle, the vertex of said pyramid lies directly above the center of the base, the height of said pyramid is equal in length to one half the length of a diagonal of its base;

each of two of said new square based pyramids is cut into four parts along planes which pass through its top vertex and the mid-points of opposite sides of its base; each of said two new four-piece square based pyramids is adjoined to a four-piece square face, say the top or bottom square face of the truncated 2×2×2 cube sub-puzzle;

each of the remaining four of said new square based pyramids is cut into four parts along planes which pass through its top vertex and the diagonals of its base; each of said four new four-piece square based pyramids is adjoined to a two-piece square face, say the four square vertical faces of the truncated 2×2×2 cube sub-puzzle;

each sub-piece of said new four-piece square based pyramid is extended along the common edge of the sub-pieces by a knob in such a way that in the rest position, the four identical knobs of each four-piece square based pyramid adjoined to one face of the truncated 2×2×2 cube sub-puzzle fit in and practically fill the space of a groove;

admissible rotations, twists and turns make it possible for the sub-pieces of the new four-piece square based pyramids to migrate from one square face of the truncated 2×2×2 cube sub-puzzle to another face.

* * * * *